United States Patent [19]

Quigley et al.

[11] 4,450,321

[45] May 22, 1984

[54] CIRCUIT FOR PRODUCING NOISE GENERATION FOR SOUND MASKING

[76] Inventors: William D. Quigley, 132 Oakridge Ave., Nutley, N.J. 07110; Philip H. Nelson, 42 Harmony Rd., Spring Valley, N.Y. 10977

[21] Appl. No.: 328,787

[22] Filed: Dec. 8, 1981

[51] Int. Cl.[3] ..... H04R 3/00

[52] U.S. Cl. ..... 179/1.5 M; 178/22.14; 178/22.19; 364/717

[58] Field of Search ..... 179/1.5 M; 178/22.14, 178/22.19; 364/717

[56] References Cited

U.S. PATENT DOCUMENTS

| | | | |
|---|---|---|---|
| 3,639,690 | 2/1972 | Braun et al. | 178/22.19 |
| 3,681,708 | 8/1972 | Olmstead | 178/22.14 |
| 3,885,139 | 5/1975 | Hurd | 364/717 |
| 4,054,751 | 10/1977 | Calder et al. | 179/1.5 M |
| 4,109,856 | 8/1978 | van Beveren et al. | 178/22.14 |
| 4,325,129 | 4/1982 | Groth | 364/717 |

OTHER PUBLICATIONS

Electronics (11/8/78) pp. 134–136 Anderson.
Electronic Design (3/31/81) pp. 196,198.

*Primary Examiner*—Sal Cangialosi
*Attorney, Agent, or Firm*—Ralph R. Roberts

[57] ABSTRACT

An apparatus and circuit is disclosed for the generation of a masking sound noise by which unwanted noise may be overcome without undue and unwanted sound levels. The apparatus and circuits have at least two multi-stage shift registers in which the last register sends an input signal to a first exclusive OR gate and to this same OR gate an intermediate connection to the shift register is made. The output from this first OR gate is sent to the first stage of the register and this same signal is sent as an output to a second exclusive OR gate. Each shift of each register is pulsed by an asynchronous clock. A second exclusive OR gate receives the output signals from each of the first OR gates and sends the output signal to a divide-by-counter and the output therefrom is sent to amplifying means and one or more speakers.

9 Claims, 4 Drawing Figures

CIRCUIT FOR PRODUCING NOISE GENERATION FOR SOUND MASKING

BACKGROUND OF THE INVENTION

Field of the Invention

With reference to the classification of art as established in and by the Patent and Trademark Office this invention is believed to be found in the General Class entitled, "Telephony" (Class 179) and in the subclasses therein entitled, "audio analgesia" and "secret masking". Possible related reference may be found in the General Class entitled, "Surgery" (Class 128) and the subclass therein entitled, "sleep inducers".

BACKGROUND OF THE INVENTION

Many patents and magazine articles have shown the desirability of masking talk sounds from associates and the like. Many times the conversations are confidential or should be confidential. Circuits for producing pseudo-random signals have been found in many U.S. Patents purporting to show the desired masking. In so far as is known, these circuits produce unwanted sounds resulting in highs or lows of sound frequency.

Researchers, inventors and others working in the acoustic field have long been aware of the benefits and desirability of sound masking for various uses such as in partially divided office enclosures. Music has and is used to produce a background and although continuously produced may and often does become distracting to the listener or listeners over an extended period of time. This is particularly prevelant if the music is of a type which the listener may not find pleasing.

In particular, recent efforts for producing sound masking and distracting unwanted sounds or noises have been focused on the psychological and physiological effects of the generation of sounds. These efforts have not been sufficient or of a quality and quantity to desensitize and reject and/or mask unwanted sounds or noise. These efforts for circuits and electronic apparatus therewith have not produced a successful breakthrough as these efforts have produced bulky and/or expensive apparatus. Many, if not all, of such devices have an inability to reject all unwanted sounds or noise and the produced masking noise may in and of itself be annoying to the listener or listeners.

Among the many patents pertaining to sound or noise masking particularly to be noted is U.S. Pat. No. 4,054,751 to CALDER et al., as issued Oct. 18, 1977; U.S. Pat. No. 3,885,139 to HURD as issued May 20, 1975 and U.S. Pat. No. 3,681,708 as issued to OLMSTEAD on Aug. 1, 1972. Several publications pertaining to this problem and solutions thereof have been written and among those to be noted are "Uniting number generators for long bit patterns" by Leonard H. Anderson in ELECTRONICS, Nov. 9, 1978, Pages 134, 135 and 136 and also "Digital Pseudo-random number generator produces analog noises for testing" and circuit therefor as shown in ELECTRONIC DESIGN for Mar. 31, 1981, Pages 196 and 197. In these and other masking apparatus there is found either a very expensive apparatus and/or apparatus producing unwanted peak or negative signals that repeat sufficiently to be annoying, said repeats not providing the desired random noise production. In U.S. Pat. No. 3,885,139 to HURD and other patents, a number of pseudo-random noise generators are used with a number of different mixing schemes for producing a pseudo-random noise by various combined digital and analog means whereas in the hereinafter described circuit and apparatus a direct approach is made resulting in a less expensive and more reliable assembly.

The present invention provides a circuit and apparatus for a direct maximizing of pseudo-random noise wherein each generator has its asynchronous clock and the output from each generator is connected to an exclusive "OR" gate to produce a multiplied pseudo-random signal. The circuit and apparatus of the present invention can be extended if desired or required so that several pseudo-random generators can be connected so as to form a virtual random generator with an indeterminate time to repeat its pattern. In the circuit and apparatus to be hereinafter more fully described the digital random noise output can be divided by a modulo of two or greater so that the consequent higher harmonics are not emphasized at the expense of low frequency bass.

SUMMARY OF THE INVENTION

This invention may be summarized, at least in part, with reference to its objects. It is an object of this invention to provide, and it does provide, a circuit and apparatus for producing pseudo-random noise sound or signal of high uniformity and repeatability, said produced noise useful in rejecting and/or masking unwanted sounds and/or signals and making them unintelligible over a time period.

It is a further object of this invention to provide, and it does provide, a circuit and apparatus for producing pseudo-random noise which is unitary in construction and compact in size allowing installation and application within an enclosure or partition surrounding the listener or listeners or outside the partition in an unobtrusive location. This sound masking apparatus may be placed in the listener's environment to surround the ear with a zone of masking noise to make unwanted sounds or noise unintelligible.

It is a still further object of this invention to provide, and it does provide, a circuit and apparatus which does not incorporate semiconductors, junctions or vacuum tube devices which may work but often require "tuning" for bass or treble levels. This tuning if often necessary because of time and/or temperature shifts. Applicant's circuit and apparatus does not include complicated or cumbersome implementation of digital techniques and additional randomizing of these digital patterns. The present apparatus does not tend to repeat the noise pattern or to produce long gaps in the noise pattern at the end of the pattern. Such gaps produce sounds somewhat like repeated metronome-like notes or drum beats.

In brief, this circuit and apparatus provides a circuit and apparatus of inexpensive construction and small in size. This sound producing apparatus is absent peak and valley cycles and does not require additional tuning for time and/or temperature. The circuit and apparatus includes two or more multi-stage shift registers, each with its own asynchronous clock with the outputs from these registers fed to an exclusive or gate and then to a divide-by-counter. From this counter the output is fed to filters, amplifiers and speakers. Shown hereinafter are two circuits, one employing two shift registers and the other three registers. More register circuits and apparatus may be employed if desired.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of circuits for producing noise generation as adopted for use for sound masking and showing a preferred means of design and assembly. These specific embodiments have been chosen for the purposes of illustration and description as shown in the accompanying drawings wherein:

BRIEF DESCRIPTION OF THE DRAWINGS

In the following discription and in the claims various details are identified by specific names for convenience. These names are intended to be generic in their application. Corresponding reference characters refer to like members throughout the several figures of the drawings.

DETAILED DESCRIPTION OF THE DRAWINGS

Figure 1:
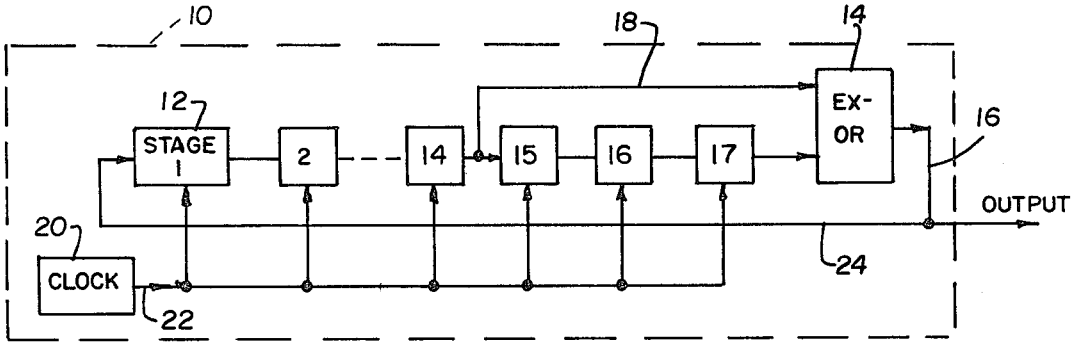
PRIOR ART FIG. 1
FIG. 1 represents a block diagram of a (seventeen) stage shift register for producing a single pseudo-random noise generation, this diagram showing a typical circuit and labeled "prior art"

Embodiment of FIG. 1

Referring next to the FIGS. and in particular to FIG. 1, it is to be noted that this diagram or circuit shows a circuit and apparatus which is conventional and is labeled "Prior Art". A shift register 10 is commercial and is sold as a unit. A dashed outline shows the assembly thereof. Depicted is a seventeen stage shift register with stage I (flip-flop) identified as 12, repeated sixteen other times. Shift registers of less or more stages may be employed but the output signal from one shift is made as an input to the next shift. From the last stage (17 as shown), the signal or output is delivered to an exclusive OR gate identified as 14. A conductor 16 is attached to the output of exclusive OR gate 16 and returns the output signal back to the first signal stage of the shift register. As depicted, this exclusive OR gate 14 is also fed an input signal through conductor 18 which carries the output from an intermediate stage and sends this signal to the OR gate 14.

A clock 20 delivers a pulse to each stage of the shift register 10. If the register has seventeen stages as shown there are signals sent to each stage. Conducting means identified as 22 carry this pulse to each stage. Also the output signal from the exclusive OR gate 14 as carried in a conductor 24 is fed to amplifiers and speakers also well known.

The shift register shown has seventeen stages but more or less may be employed and the modulo or number of shifts is merely a matter of use, design and economics.

Figure 2:
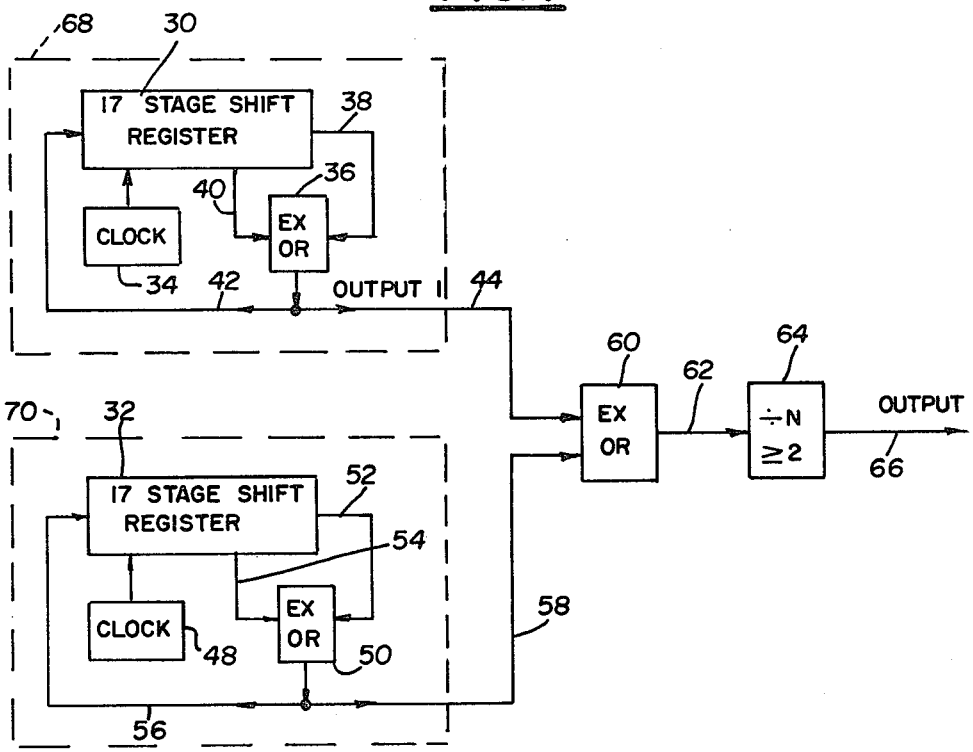
FIG. 2 represents a diagram similar to that of FIG. 1 and showing an interconnection of two pseudo-random noise generators feeding to an exclusive OR gate and with the output thereof fed to a divide-by-counter and the signal therefrom sent to filters, amplifiers and speakers, etc.

Embodiment of FIG. 2

In FIG. 2 is shown the preferred circuit and apparatus employing a plurality of circuits such as found in FIG. 1. In this circuit seventeen stages are depicted and in a first circuit is identified register 30 and the second register is identified as 32. Each register is commercial and is preferably substantially identical. The register 30 is driven by an asynchronous clock 34 and feeds pulses to each shift as in FIG. 1 above. An exclusive OR gate 36 receives input signals from the last shift through a conductor 38 and also a signal by conductor 40 from an intermediate shift in the register 30. The output from exclusive OR gate 36 sends a pulse signal to register 30 through a conductor 42 and also through another conductor 44 to apparatus to be hereinafter described.

The second shift register 32 is driven by another asynchronous clock 48 which feeds pulse signals to each shift as in FIG. 1. An exclusive OR gate 50 is fed input signals from the output of the last shift through a conductor 52 and from an intermediate shift through a conductor 54. The output from this exclusive OR gate 50 is fed through conductor 56 to the first stage of the register 32 and then as an output signal through conductor 58 to other apparatus.

The signal from and through conductor 44 is fed to yet another exclusive OR gate 60 and this gate also receives the signal through conductor 58. These signals, as a multiplied pseudo-random signal product of and from the two generators, are sent through a conductor 62 to a divide-by-counter 64 and from this counter is sent as an output signal 66 to amplifiers and speakers not shown. This counter may be or like that of Texas Instrument's part number Ser. No. 7493 or the like. The output signal 66 yields a pseudo random bit stream from a plurality of generators and with an asynchronous clock means associated with only that register.

It is to be noted that the two registers are driven by clocks that are asynchronous and are not in synchronism. An additional exclusive OR gate receives the electronic signal and the output is fed to a divide-by-counter 64. The two circuits associated with registers 30 and 32 are usually mounted on and are carried by printed circuit boards. The register 30 is mounted on a board identified as 68 and register 32 is on a board identified as 70. PC boards and the like are suggested as they permit removal from commercial installations with the minimum of downtime and reparis or replacement are easily achieved. PC (printed circuit) boards provide a means for mounting the electrical components and with said boards enabling rapid inspection, repair or replacement.

Testing of the components is easily achieved when a PC board is assembled as one of many like or similar units.

Figure 3:
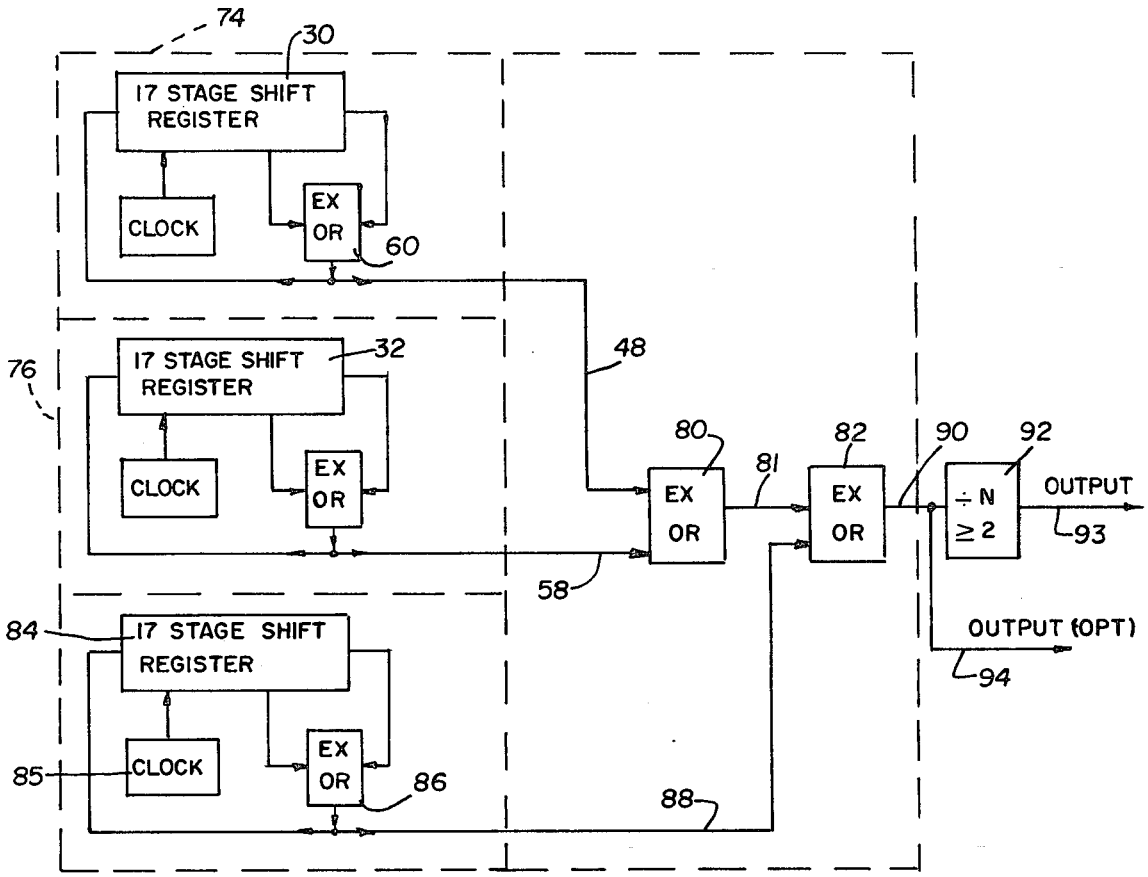
FIG. 3 represents a diagram similar to that of FIG. 2 but showing the use of three generators and an extra exclusive OR gate to the output.

Embodiment of FIG. 3

In FIG. 3 the apparatus and circuit of FIG. 2 is shown but with an additional shift register and associated control components. Depicted are three shift registers with the first shift register 30 and associated components identified as 74 and the shift register 32 and associated components identified as 76 arranged as in FIG. 2 with a third shift register 84. A clock and exclusive OR gate is arranged as in FIG. 2. As seen, the output of shift register 30 and register 32 and the exclusive OR gate associated therewith is fed to the exclusive OR gate 60. Rather than to a divide-by-counter this signal is fed as one of two input signals to yet another exclusive OR gate 80. The output of the shift register 32 is sent as the other signal input to the exclusive OR gate 80. The output signal from gate 80 is sent through conductor 81 as an input signal to yet another exclusive OR gate 82.

A third shift register 84 which is identical or like registers 30 and 32 is driven or pulsed by yet another asynchronous clock 85 and with another exclusive OR gate 86 connected to the last stage of the shift register and also to the intermediate portion of the shift register as in FIG. 2. The output of this shift register circuit is fed through a conductor 88 to yet another exclusive OR gate 82 which receives the signals in and through conductors 81 and 88 and with the output from this OR gate 82 sent through a conductor 90 to a divide-by-counter 92 as above described. From this counter 92 a signal 93 is sent to amplifying and speaker means commercially available. A conductor 94 is indicated as available to carry signals to other amplifiers, dividers and the like as desired.

Figure 4:
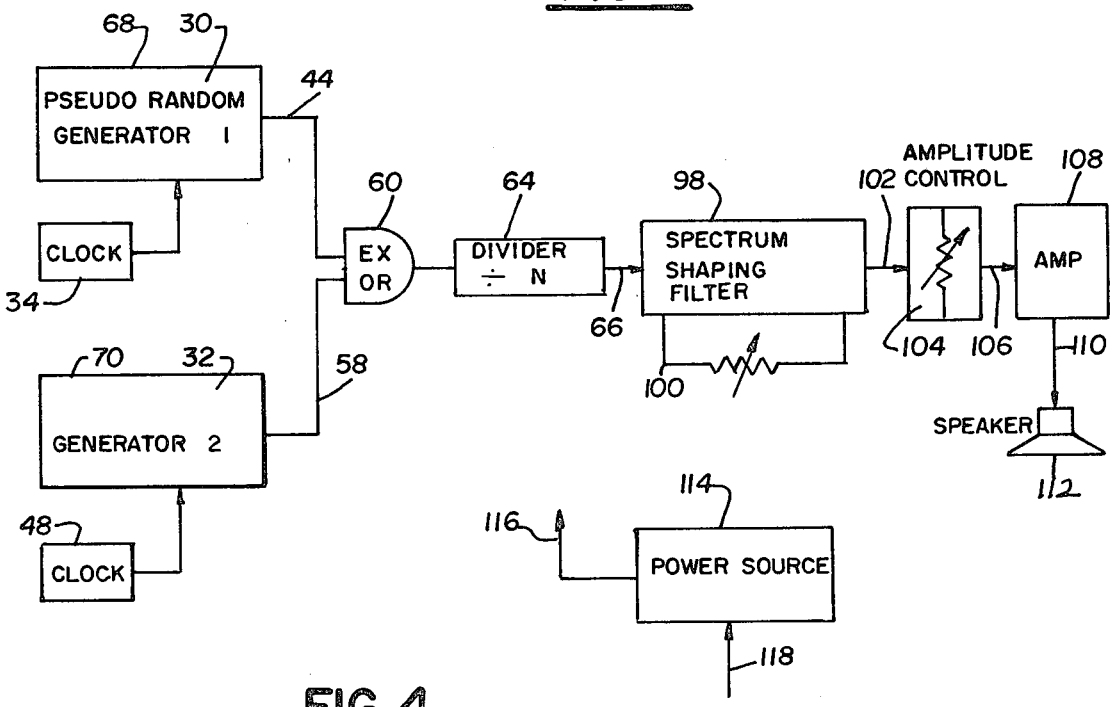
FIG. 4 represents a basic block diagram schematic of a noise masking circuit and showing a preferred embodiment of this invention.

Embodiment of FIG. 4

Referring next and finally to the circuit and apparatus a shown in FIG. 4, the depicted embodiment includes the pseudo-random generator 68 No. 1 which includes a register 30 as shown in FIG. 2. The shift register therein is driven by clock 34 as above described. The second generator 70 which includes register 32 is also described in conjunction with FIG. 2 above and is driven by a clock 34. The output of generator No. 1 is carried by conductor 44 to exclusive OR gate 60 and the output of generator No. 2 is carried in and by conductor 58 to this same gate 60. The output of this OR gate is carried to the divide-by-counter 64 which sends a signal through a conductor 66 to a spectrum shaping filter 98.

Spectrum shaping filter 98 is shown with a variable resistor 100 which adjusts the capability of the filter in a conventional manner. The output of this filter is carried through a conductor 102 to an amplitude control 104 which tailors the sounds to the lows and highs desired. The signals from this control are sent through a conductor 106 to an amplifier 108 of selected design and capability. The output from amplifier 108 is fed through a conductor or conductors 110 to a speaker or speakers 112. A power source 114 sends the desired current (volts-amperes) through a conductor 116 to the apparatus above described. A conductor 118 supplies the power source 114 from an electrical supply such as AC, batteries and the like.

It is to be noted that the several components utilized in the above apparatus and circuit or circuits are commercially available but the arrangement of these components is believed to be novel. The shift register of the several FIGS. is depicted as having seventeen stages but this does not preclude shift registers of less or more stages and with an even or odd number of stages. Preferably the connection from the intermediate stages is at a number that is opposite the output number (Viz. even if odd and odd if even). The amplifier and power source are selected for the problem to be corrected. If the noise to be masked is large, more volume is required and if the nosie to be masked is low or small, the volume required is less. Speakers are small and with a range sufficient to provide the Hertz required. The frequencies are usually from one hundred to five to six thousand Hertz. This again is a matter of preferance and accommodation.

Terms such as "left", "right", "up", "down", "in", "out" and the like are applicable to the circuits shown and described in conjunction with the drawings. These terms are merely for the purposes of description and do not necessarily apply to the position in which the circuits and apparatus may be constructed or used.

While a particular circuit for noise masking has been shown and described it is to be understood the invention is not limited thereto and protection is sought to the broadest extent the prior art allows.

What is claimed is:

1. Apparatus and circuit for generating audible masking noise which is a yield of a random bit stream with an indeterminate period to repeat its pattern, said noise producing apparatus including:
   (a) at least two multi-stage shift registers, each with a first conducting means as an input to a first exclusive OR gate;
   (b) an input signal carried from an intermediate shift from said multi-stage shift register and providing another input to said first exclusive OR gate;
   (c) an asynchronous clock connected to each stage of said multi-stage register, said clock associated with each and only one multi-stage register and to feed pulse signals to each shift used in said register;
   (d) output conducting means from said first exclusive OR gate with said output leading from said first exclusive OR gate to and as an input to the multi-stage shift register and from this same output feeding to a conducting means an output signal;
   (e) a second exclusive OR gate which receives as inputs the output signals from the two first exclusive OR gates, and
   (f) an output signal from this second exclusive OR gate as a random bit stream with an indeterminate period to repeat its pattern.

2. Apparatus and circuit as in claim 1 which further includes a divide-by-counter added to receive the output signal from said second exclusive OR gate and from said counter to generate an output signal.

3. Apparatus and circuit as in claim 1 in which the shift register is odd in the number of shifts and the output signal sent to the first exclusive OR gate is from the last shift and from a shift intermediate that shift which is after an even number shift.

4. Apparatus and circuit as in claim 3 in which the multi-shift register has seventeen stages.

5. Apparatus and circuit as in claim 2 in which there is provided more than two multi-shift registers and with each added shift register there is an added exclusive OR gate which receives as inputs the output of the second exclusive OR gate and the output signal from the added shift register, the output of this added exclusive OR gate being sent to the divide-by-counter.

6. Apparatus and circuit as in claim 4 in which there is provided a further output signal sent before the divide-by-counter.

7. Apparatus and circuits as in claim 1 which subsequent to the divide-by-counter includes a spectrum shaping filter, an amplitude control, an amplifier and one or more speakers and a power source.

8. Apparatus and circuits as in claim 6 in which there is provided a variable resistor to adjust the capacity of the spectrum shaping filter.

9. Apparatus and circuits as in claim 1 in which the small electronic components are mounted on and attached to printed circuit boards removably mountable in the apparatus for eacy replacement and repair.

* * * * *